US008002234B2

(12) United States Patent
Rodin

(10) Patent No.: US 8,002,234 B2
(45) Date of Patent: Aug. 23, 2011

(54) DEVICE FOR FORMING CONCRETE

(76) Inventor: Martin D. Rodin, Lockport, IL (US)

( * ) Notice: Subject to any disclaimer, the term of this patent is extended or adjusted under 35 U.S.C. 154(b) by 702 days.

(21) Appl. No.: 11/891,130

(22) Filed: Aug. 9, 2007

(65) Prior Publication Data

US 2008/0035831 A1 Feb. 14, 2008

Related U.S. Application Data

(60) Provisional application No. 60/837,166, filed on Aug. 12, 2006.

(51) Int. Cl.
*E04G 13/04* (2006.01)

(52) U.S. Cl. ..... 249/25; 249/48

(58) Field of Classification Search ..... 249/23–25, 249/48, 51, 34
See application file for complete search history.

(56) References Cited

U.S. PATENT DOCUMENTS 786,622 A * 4/1905 Brayton ..... 249/19
871,879 A * 11/1907 Middleton ..... 249/42
881,183 A * 3/1908 Guyer ..... 249/48
991,606 A * 5/1911 Carroll ..... 269/122
1,170,753 A * 2/1916 Hodges ..... 249/49
2,572,081 A * 10/1951 Wallance ..... 312/265.4
2,975,498 A * 3/1961 Plattner ..... 249/48
2,979,800 A * 4/1961 Wilbur et al. ..... 249/19
3,021,586 A * 2/1962 Uruburu ..... 249/48
3,672,626 A * 6/1972 Thornton ..... 249/48
3,790,121 A * 2/1974 Sels et al. ..... 249/219.1
3,795,393 A * 3/1974 Melfi ..... 269/116
4,439,071 A * 3/1984 Roper, Jr. ..... 405/216
4,604,250 A * 8/1986 Ecker ..... 264/35
4,958,800 A * 9/1990 Carlson ..... 249/219.1
6,865,859 B2 * 3/2005 Flathau ..... 52/742.14
6,899,535 B2 * 5/2005 Mihelcic et al. ..... 425/123
2009/0232606 A1 * 9/2009 Penza ..... 405/257

* cited by examiner

*Primary Examiner* — Janet M Wilkens
(74) *Attorney, Agent, or Firm* — Cherskov & Flaynik

(57) ABSTRACT

A device 10 for forming concrete includes a first form 12 dimensioned to surround substantially one-half of a predetermined object 13, such as a vertical column 13, from a preselected distance; a second form 14 dimensioned to surround substantially one-half of the column 13 from substantially the same preselected distance; joining members 16 for detachably joining end portions 18 of the first and second forms 12 and 14; and securing members 20 for removably securing the first and second forms 12 and 14 to the column 13 after joining together the end portions 18 of the first and second forms 12 and 14 about the column 13. The joined first and second forms 12 and 14 remain substantially stationary as concrete is poured into the device 10; whereupon, the concrete ultimately hardens and the device is quickly removed and re-positioned about another vertical column 13.

9 Claims, 10 Drawing Sheets

DEVICE FOR FORMING CONCRETE

This application is based on U.S. Provisional Application No. 60/837,166, filed on Aug. 12, 2006.

BACKGROUND OF THE INVENTION

1. Field of the Invention

This invention relates to a device for forming concrete, and more particularly, to a device for forming concrete about a vertical column installed to support framework upon which a building is fabricated.

2. Background of the Prior Art

Vertical steel columns or beams are secured in position via concrete "footers" with threaded bars protruding from a top surface. The columns are secured to the threaded bars via a plurality of threaded nuts. The columns sometimes require "shims" to vertically dispose the column before securing the column to the footer. After all vertical columns have been installed, wooden forms are fabricated about the footers. Concrete is then poured into the forms and allowed to harden. After the concrete hardens, the forms are forcibly removed.

The prior art wooden forms used to form concrete about the vertical columns are fabricated from wooden boards, are manually assembled about the vertical column, and held in place about the vertical column by wooden stakes driven into a ground area adjacent to the assembled wooden form. The stakes are then nailed to the assembled wooden form.

The problem with prior art wooden forms used to configure concrete about a vertical column, is that once concrete is poured into the wooden form and allowed to harden, the wooden form is ultimately damaged while being removed from the hardened concrete. The prior art wooden forms cannot be re-used to pour concrete about another vertical column, resulting in a wooden form being manually built about every vertical column installed in a building. Fabricating a wooden concrete form about every vertical column, results in an increase in material and labor costs to ultimately form concrete about each vertical column.

A need exists for a durable, rigid, concrete form capable of being manually carried to and disposed about a vertical column. The concrete form must be capable of being manually elevated to a level position irrespective of the ground surface that the form sets upon. Further, the concrete form must remain stationary, irrespective of the force imparted from flowing concrete engaging the concrete form. The concrete form must remain stationary without using stakes driven into the ground adjacent to the concrete form disposed about the vertical column.

SUMMARY OF THE INVENTION

It is an object of the present invention to overcome many of the disadvantages associated with prior art devices for forming concrete about a vertical column.

A principal object of the present invention is to provide a device for forming concrete. A feature of the device is first and second forms with substantially similar dimensions and configurations. An advantage of the device is that the two forms are detachably joined together about an object such as a vertical column, thereby promoting fast form assembly to form concrete poured about the vertical column, and fast form disassembly once the concrete hardens.

Another object of the present invention is to provide a device that is removably secured to the vertical column. A feature of the device is securing members or adjustable clamps joined to extension members which are integrally joined to the first and second forms. An advantage of the device is that securing members maintain the position of the joined first and second forms relative to the vertical column as relatively heavy liquid concrete forcibly engages the joined first and second forms.

Yet another object of the present invention is to provide a device that is leveled or otherwise elevated at multiple locations by elevating rods that engage an undulating ground surface. An advantage of the device is that each side of the device is disposed substantially parallel to the vertical column before the first and second forms are secured to the vertical column. An advantage of the device is that the first and second forms are further stabilized during the concrete pour to ultimately provide a hardened planar concrete surface that is perpendicular to the vertical column.

Another object of the present invention is to provide a device that is manually transported. A feature of the device is integrally joining extension members to the first and second forms at preselected locations. An advantage of the device is that a user is capable of lifting separated first and second forms, one in each hand, via the extension members such that both first and second forms remain distal to the user's legs as the user carries the separated first and second members to a selected concrete pour work site.

Briefly, the invention provides a device for forming concrete comprising a first form dimensioned to surround substantially one-half of a predetermined object from a preselected distance; a second form dimensioned to surround substantially one-half of the predetermined object from substantially the same preselected distance; means for detachably joined end portions of said first and second forms; and means for removably securing said first and second forms to the predetermined object, whereby said joined first and second forms remain stationary as concrete is poured into said joined first an second forms to ultimately harden and configure a foundation about the predetermined object.

The invention further provides a device for forming concrete about a vertical column comprising a concrete form having at least two separable portions that surround a vertical column; means for securing said separable portions together while disposing said separable portions about the vertical column; and means for securing said separable portions to the vertical column.

The invention also provides a method for forming concrete about a column, said method comprising the steps of providing a form having a predetermined configuration with predetermined dimensions; disposing said form about a column; joining together end portions of said form; elevating said form to predetermined settings; and securing said form to the column, whereupon, concrete is poured into said form and allowed to harden thereby allowing said form to be removed from the hardened concrete.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
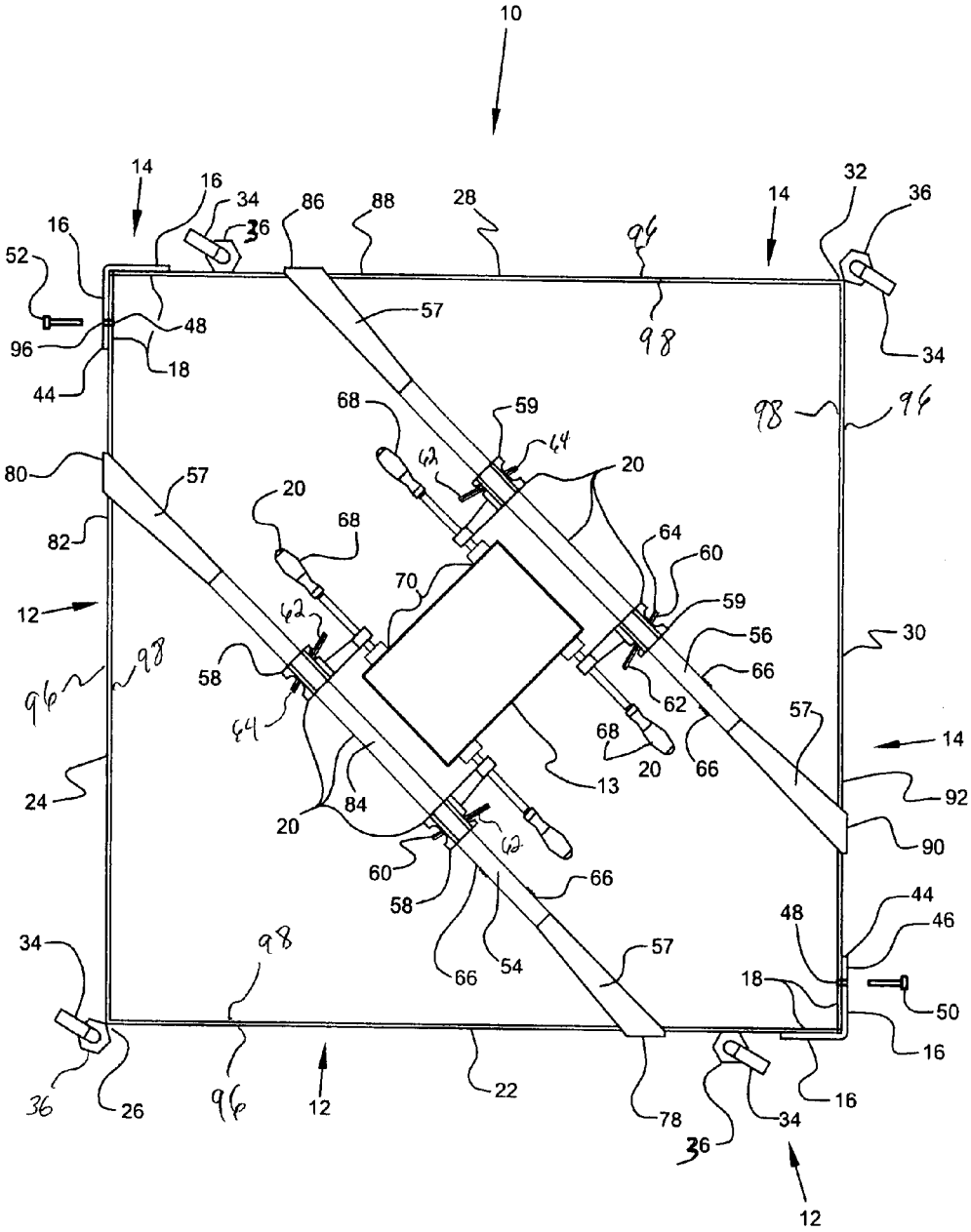
FIG. 1 is a top view of a device for forming concrete in accordance with the present invention, the device being secured to a vertical column disposed in the proximate center of the device.
Figure 2:
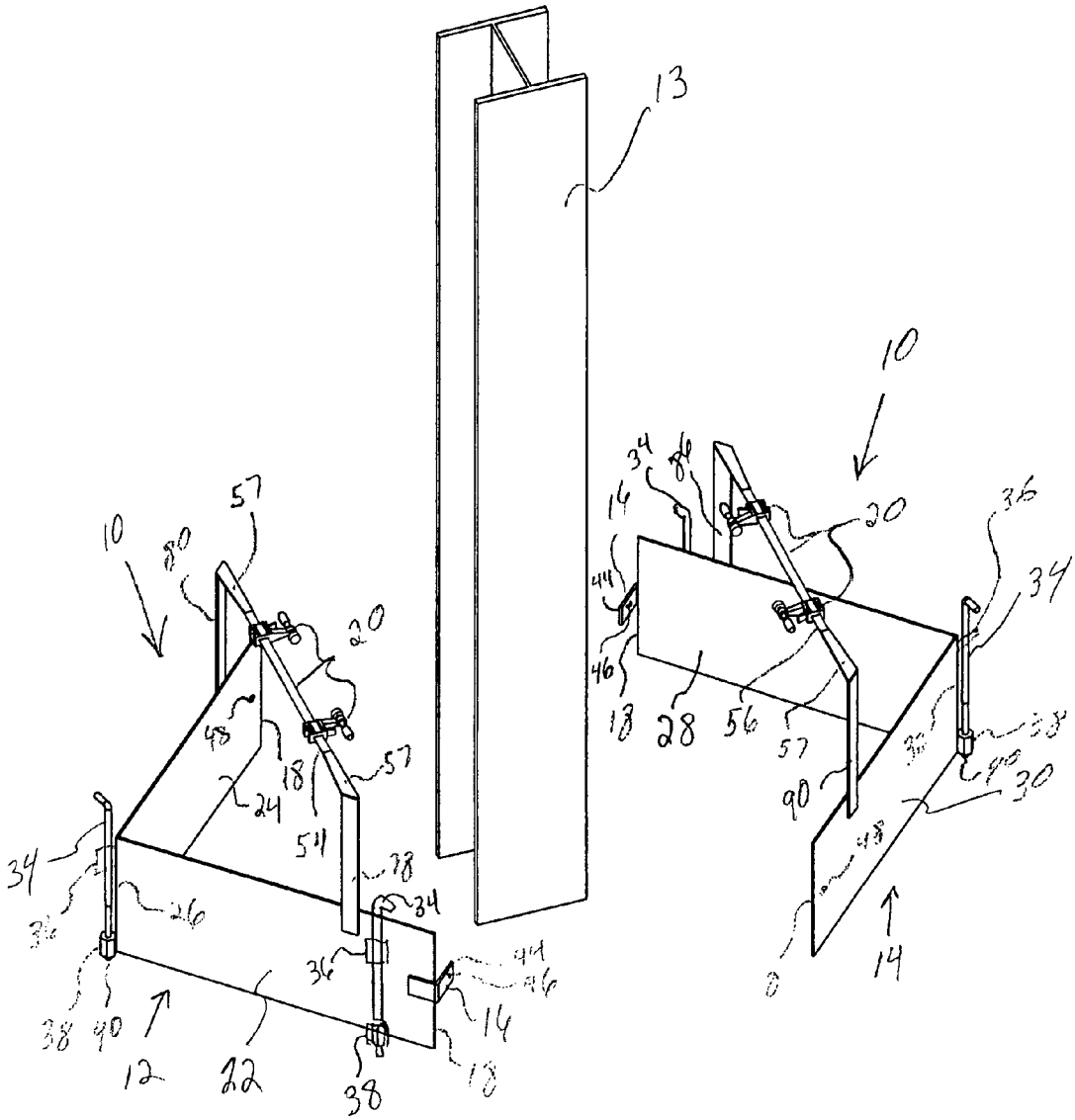
FIG. 2 is perspective view of the device of FIG. 1, but with first and second forms separated from the vertical column.
Figure 7:
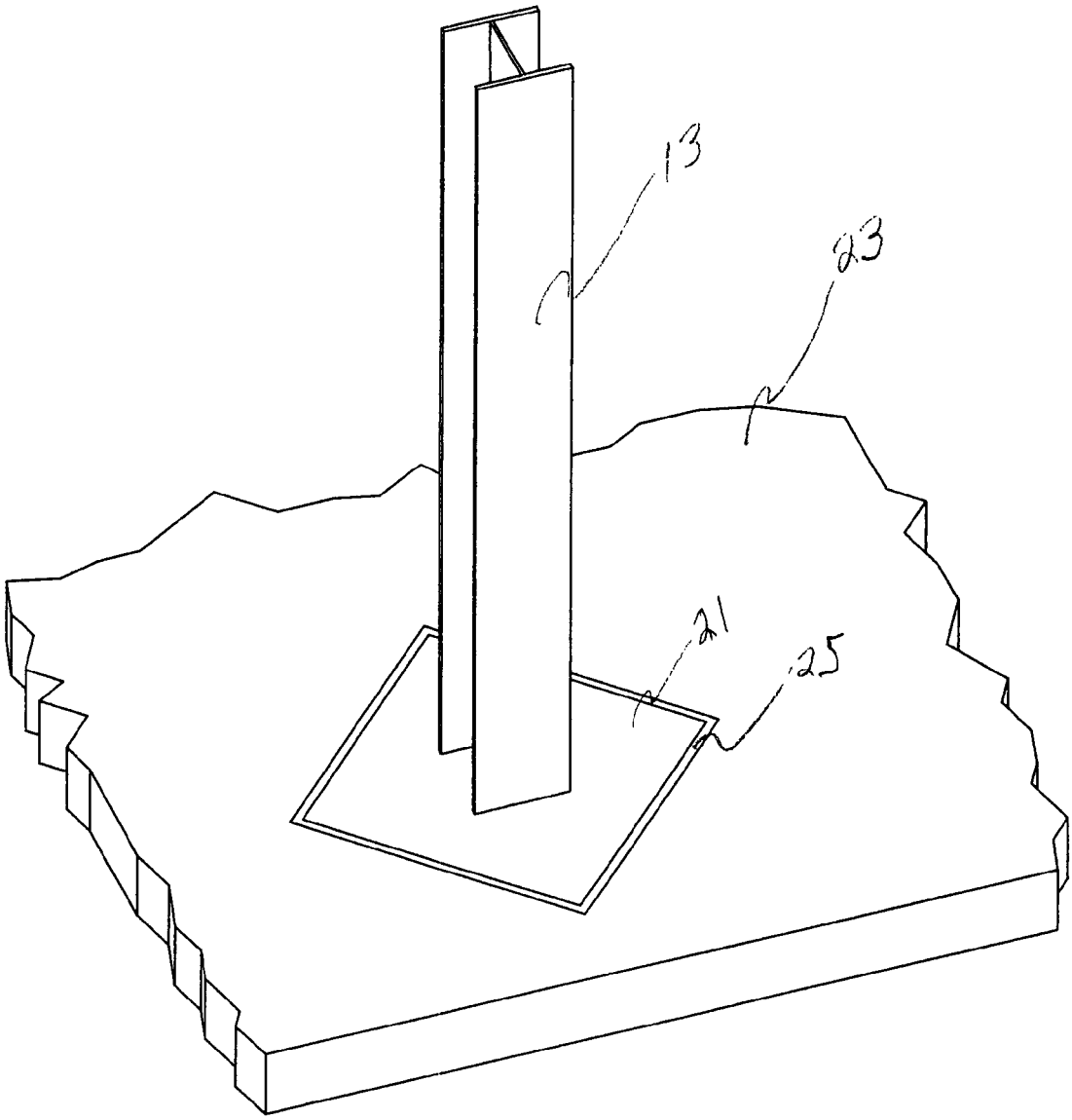
FIG. 7 is a perspective view of the vertical column surrounded by a foundation of hardened concrete formed by the device in accordance with the present invention. The foundation is flush with a concrete floor which is separated from the foundation by material that provides an expansion joint between the foundation and floor.

Referring now to the drawings, a device for forming concrete in accordance with the present invention is denoted by numeral 10. The concrete forming device 10 includes a first form 12 dimensioned to surround substantially one-half of a predetermined object 13 (not part of the invention), such as a vertical column 13 (see FIG. 1), from a preselected distance; a second form 14 dimensioned to surround substantially one-half of the predetermined object from substantially the same preselected distance; joining members 16 for detachably joining end portions 18 of the first and second forms 12 and 14; and securing members 20 for removably securing the first and second forms 12 and 14 to the predetermined object 13 after joining together the end portions 18 of the first and second forms 12 and 14 about the predetermined object 13, whereby the joined first and second forms 12 and 14 remain substantially stationary as concrete is poured into the joined first and second forms 12 and 14. The concrete ultimately hardens and configures a foundation 21 (see FIG. 7) about the predetermined object 13. The device 10 is then quickly removed and re-positioned about another vertical column 13. A concrete floor 23 is poured flush with the foundation. Expansion joint material 25 is disposed between the foundation 21 and floor 23 to prevent the foundation 21 and floor 23 from "buckling." The expansion joint material is well known to those of ordinary skill in the art.

Figure 3:
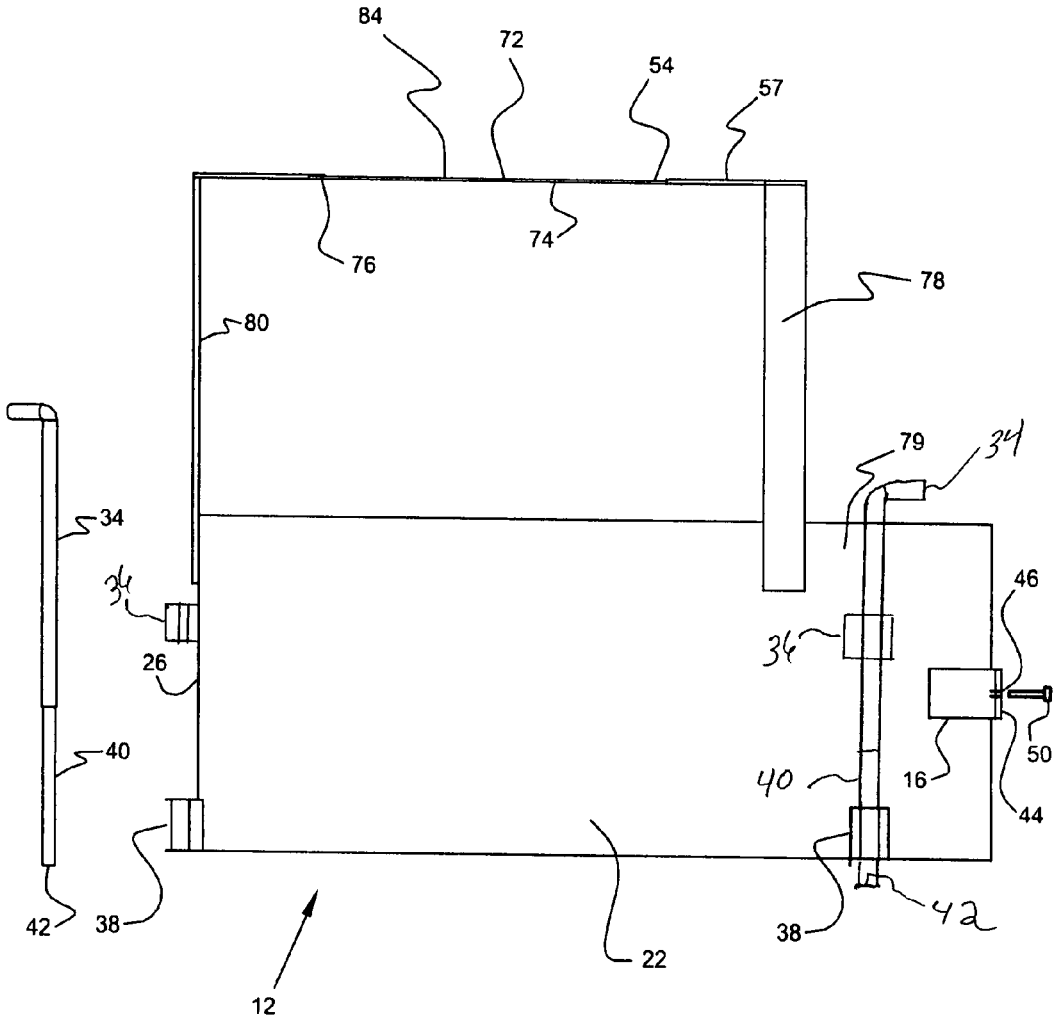
FIG. 3 is a front elevation view of the device of FIG. 1 with the elevating rod separated from the first form, but without the vertical column depicted.
Figure 4:
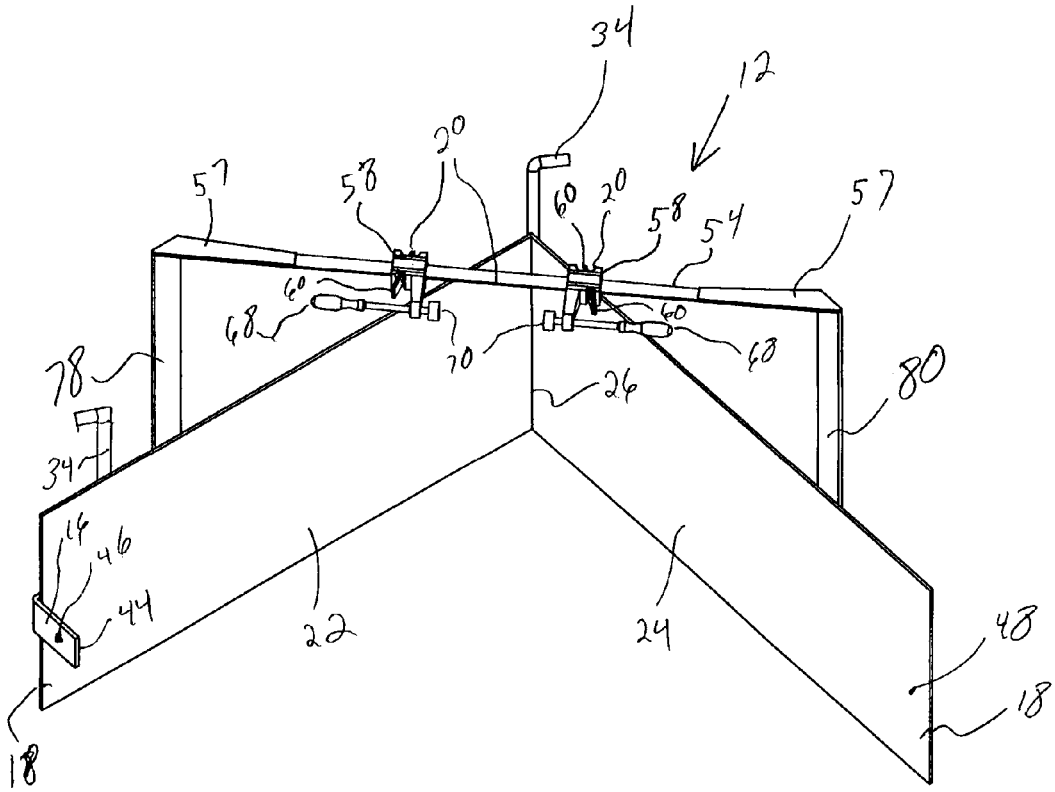
FIG. 4 is a perspective view of inner walls of the first form of FIG. 3.
Figure 5:
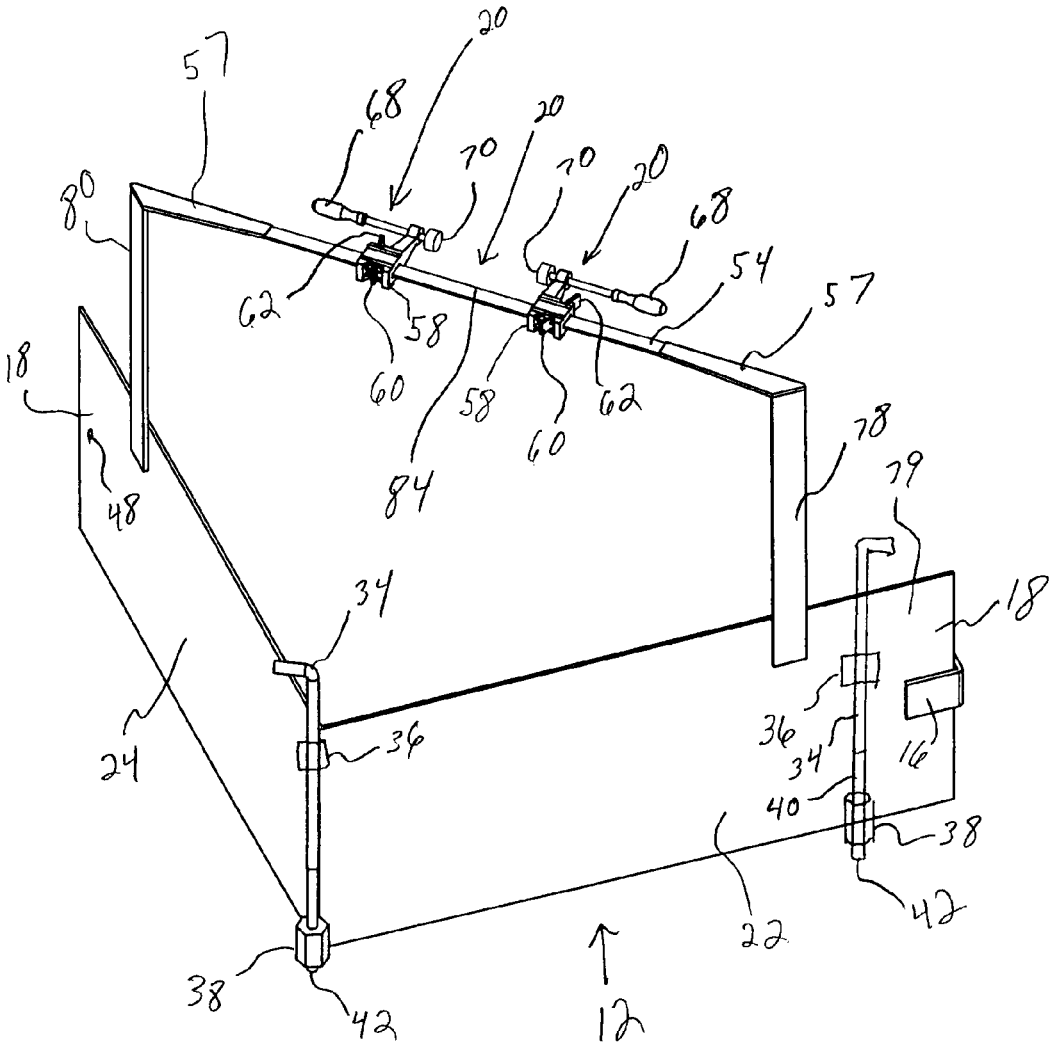
FIG. 5 is a perspective view of outer walls of the first form of FIG. 3.
Figure 6:
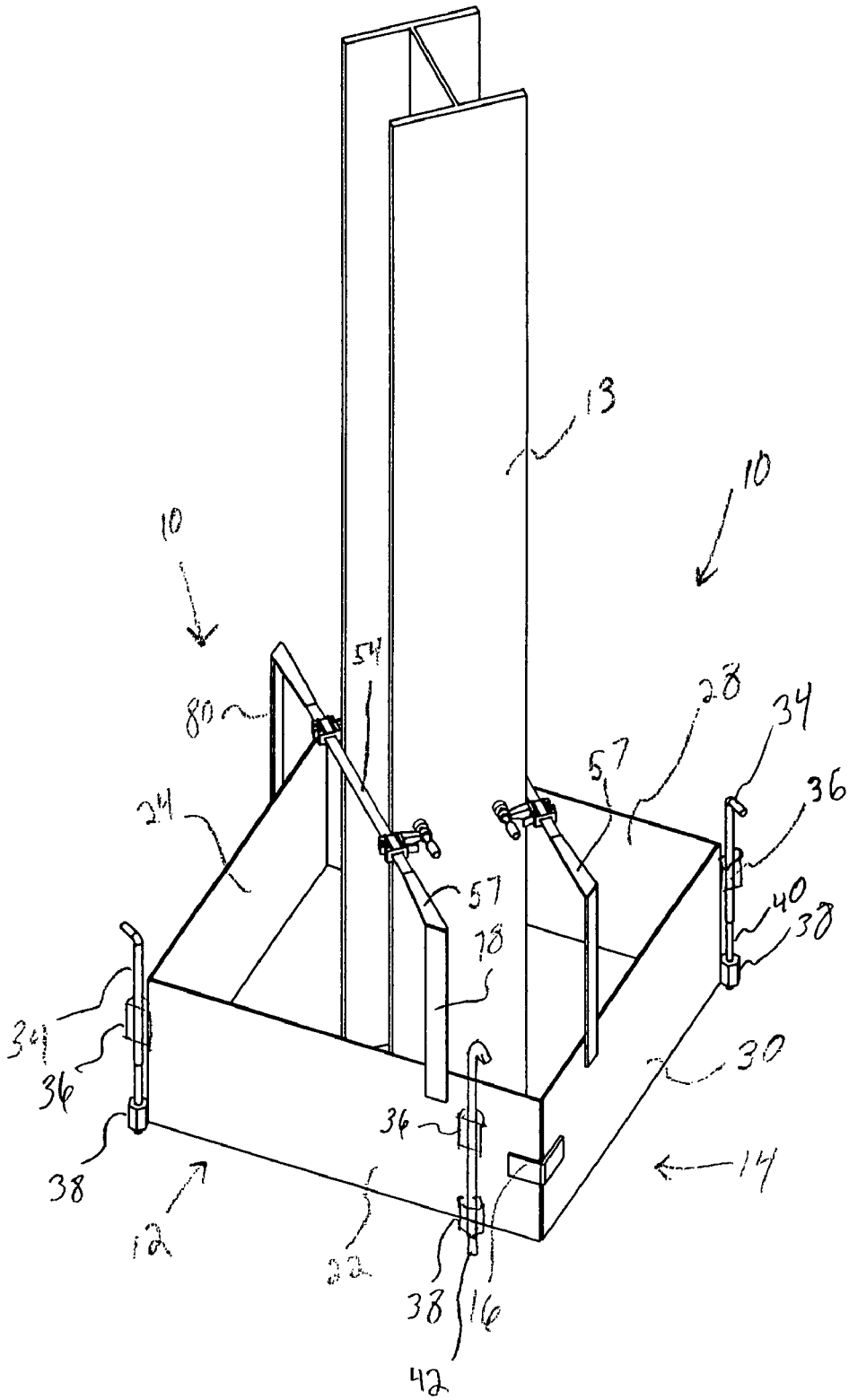
FIG. 6 is a perspective view of the device of FIG. 2, but with the first and second forms secured to the vertical column.
Figure 8:
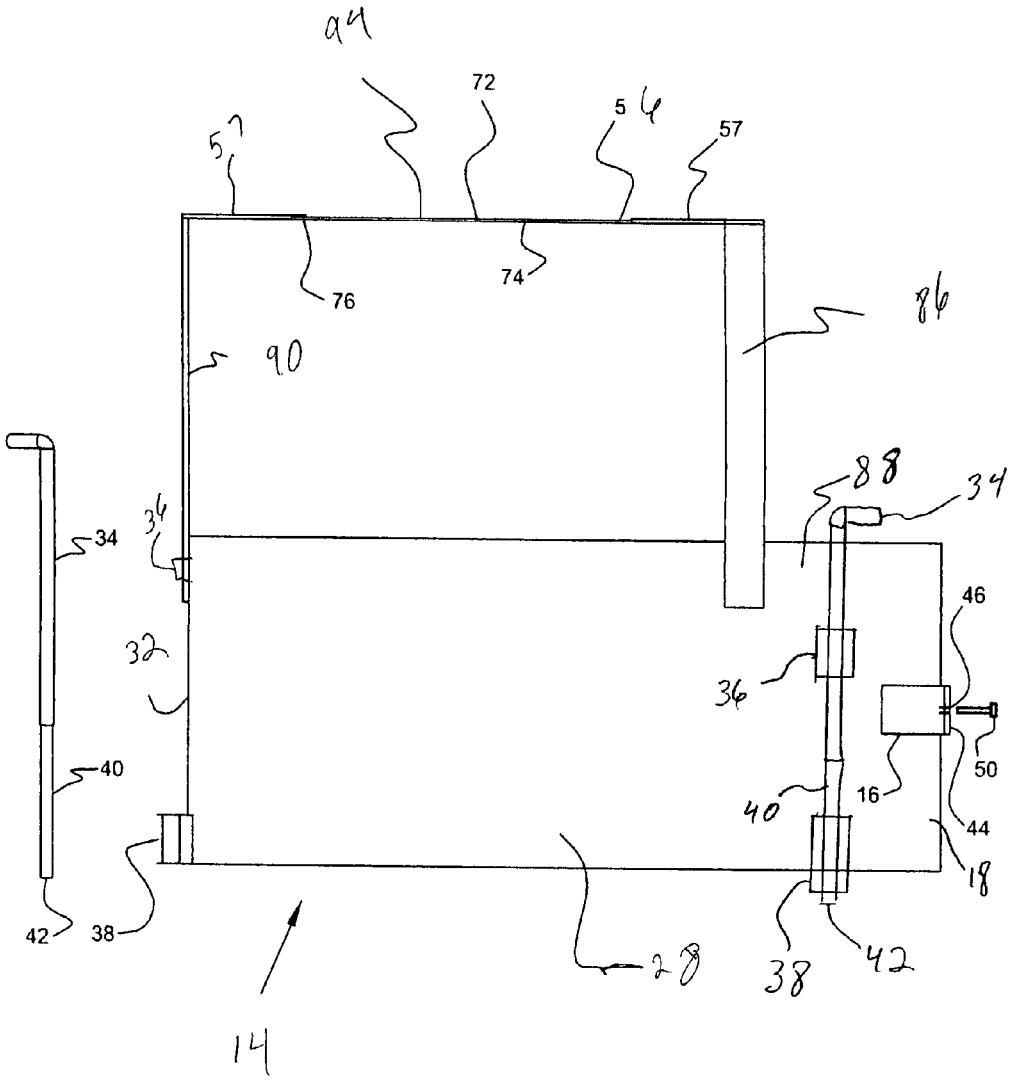
FIG. 8 is a back elevation view of the device of FIG. 1 with one elevating rod separated from the second form, but without the vertical column depicted.
Figure 9:
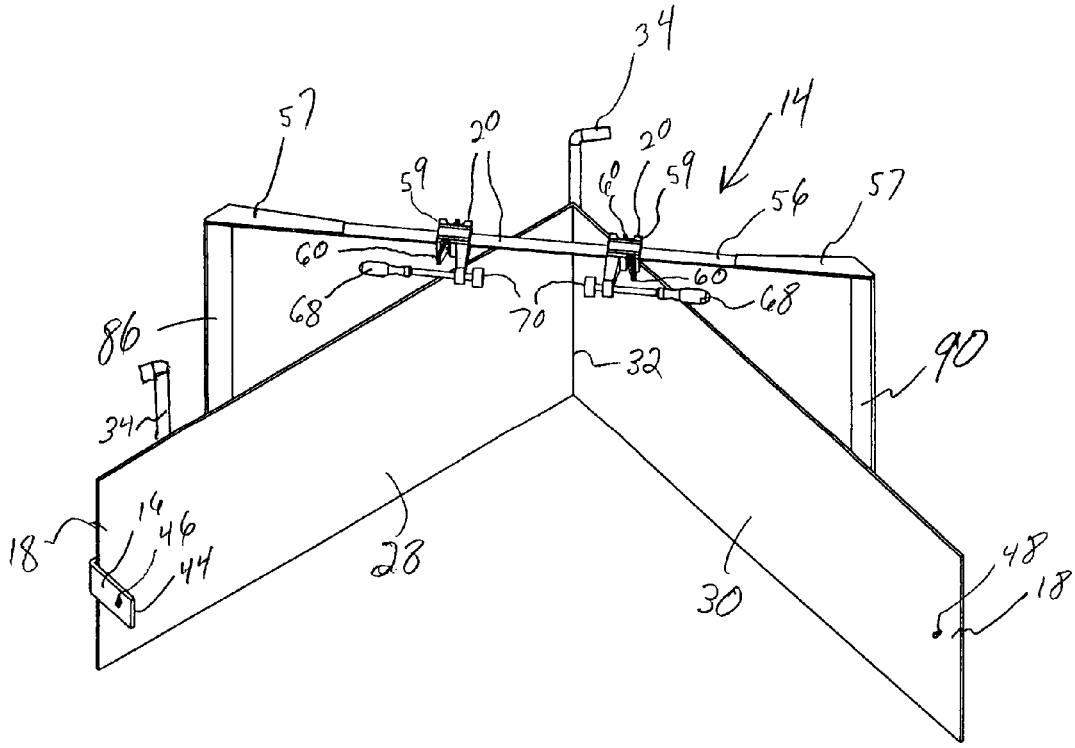
FIG. 9 is a perspective view of inner walls of the second form of FIG. 8.
Figure 10:
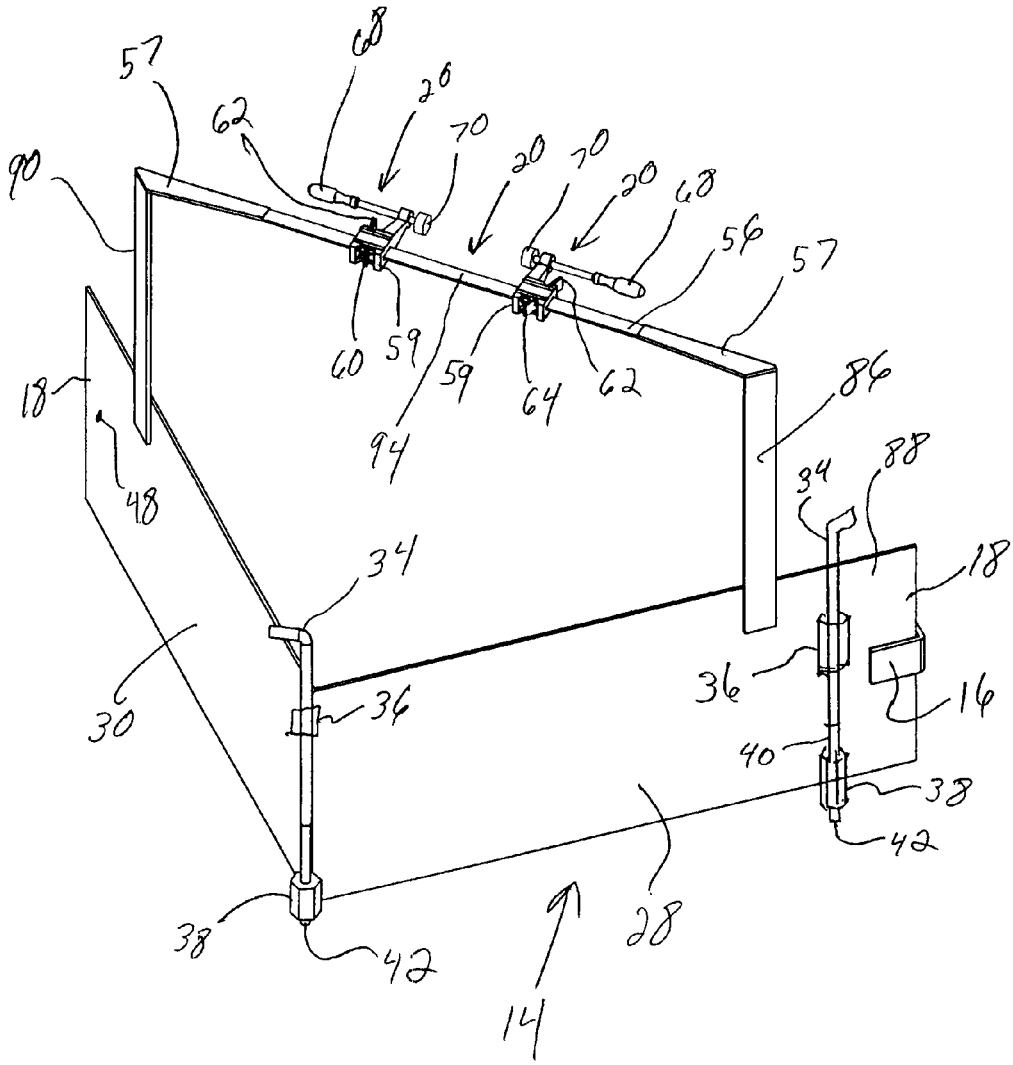
FIG. 10 is a perspective view of outer walls of the second form of FIG. 8.

The joined first and second forms 12 and 14 configure a substantially square device 10 when taking a top view of the device 10 after detachably joining the end portions 18 of first and second arms 22 and 30, and the end portions 18 of second and first arms 24 and 28 about the predetermined object 13. The first form 12 is fabricated from steel and includes first and second rectangularly configured arms 22 and 24 (see FIGS. 3-5). The arms 22 and 24 are integrally joined together at lateral edges via welding or similar means to form a first vertical mid-portion edge 26 with the first and second arms 22 and 24 forming a substantially ninety degree angle therebetween. The second form 14 is fabricated from steel and includes first and second rectangularly configured arms 28 and 30 (see FIGS. 8-10). The arms 28 and 30 are integrally joined together at lateral edges via welding or similar means to form a second vertical mid-portion edge 32 with the first and second arms 28 and 30 forming a substantially ninety degree angle therebetween.

The first and second forms 12 and 14 include elevating rods 34 disposed at each vertical mid-portion edge 26 and 32, and adjacent to each joining member 16 of the first and second forms 12 and 14, respectively. The elevating rods 34 elevate corresponding first and second forms 12 and 14 to a preselected elevation above a foundation (not depicted) for the preselected object 13 or above an undulating ground surface. The elevating rods 34 ultimately insert through an upper slide channel 36 and into a lower threaded channel 38. The upper slide channel 36 is configured and dimensioned to allow the elevating rod 34 to insert therethrough. The lower threaded channel 38 includes an inner threaded wall that cooperates with a threaded end 40 of the elevating rod 34 to rotationally receive the threaded end of the elevating rod 34 therethrough such that a tip portion 42 of the treaded end 40 engages a pier or foundation (not depicted) surrounding the predetermined object 13 or ground surface. The elevating rods 34 ultimately elevate corresponding vertical mid-portion edges 26 and 32, and end portions 18 of the first and second forms 12 and 14, thereby elevating forms 12 and 14 above the pier to ultimately achieve a preselected concrete configuration about the predetermined object 13. The upper slide channel 36 maintains alignment of a top portion of the elevating rod 34 relative to the first and second forms 12 and 14 as the elevating rod 34 forcibly elevates a respective form. The lower threaded channel 38 stabilizes and maintains the position of the elevating rod 34 as the elevating rod 34 forcibly elevates a corresponding form 12 and 14.

The joining members 16 include angled metal plates 16 integrally joined to an end portion 18 of the first arm 12 of the first form 12, and joined to an end portion 18 of the first arm 28 of the second form 14. The angle plates 16 include end portions 44 having an apertures 46 therethrough that ultimately align with cooperating apertures 48 through end portions of the second arms 24 and 30 of the first and second forms 12 and 14. A first securing rod 50 such as a nail (the head does not engage concrete) or similar metal structure ultimately extends through the aperture 46 in the end portion 44 of the angled plate 16 joined to the end portion of the first arm 22 of the first form 12. The first securing rod 50 continues through the aperture 48 in the end portion of the second arm 30 of the second form 14. A second securing rod 52 ultimately extends through the aperture 46 in the end portion 44 of the angled plate 16 joined to the end portion of the first arm 28 of the second form 14. The second securing rod 52 continues through the aperture 48 in the end portion of the second arm 24 of the first form 12.

The securing members 20 are fabricated from steel and manufactured by Jorgensen Corporation of Chicago, Ill., part number 3712-LD. The securing members 20 include a first clamp bar 54 joined to the first and second arms 22 and 24 of the first form 12, and a second clamp bar 56 joined to the first and second arms 28 and 30 of the second form 14. The first and second clamp bars 54 and 56 are attached to upper portions of respective arms 22, 24, 28 and 30 such that the first and second forms 12 and 14 are substantially balanced when a person manually lifts a form by the clamp bar, then carries the form to a new vertical column 13. To balance relatively large forms 12 and 14, the Jorgensen Corporation clamp bars 54 and 56 may have to be attached to respective arms at locations separated a distance greater than the longitudinal dimension of the clamp bars 54 and 56. To allow the Jorgensen Corporation part number 3712-LD to be used with any pair of first and second arms, extension bars 57 are integrally joined, via welding or similar means, to the securing members 20 to ultimately increase the longitudinal dimension of the securing members 20 to any required length. The extension bars 57 may include a lateral dimension relatively larger than the lateral dimension of the securing members 20 to provide increased strength and rigidity, thereby promoting the manual transportation of the first and second forms 12 and 14. The first and second clamp bars 54 and 56 with or without cooperating extension bars 57, are configured and secured to respective first and second forms 12 and 14 such that opposite top and bottom planar walls 72 and 74 form surfaces that promote the lifting and carrying of the first and second forms 12 and 14.

The securing members 20 further include opposing first clamp members 58 and opposing second clamp members 59 slidably secured to respective first and second clamp bars 54 and 56, each of the opposing first and second clamp members 58 and 59 having at least one (preferably two) locking plate 60 for maintaining a selected position for a respective first and second clamp member 58 and 59 upon respective first and second clamp bars 54 and 56. The first and second clamp bars 54 and 56 include opposite side walls 76 with serrations or "teeth" 66 that promote the locking of the locking plate 60 of the first and second clamp members 58 and 59 upon respective first and second clamp bars 54 and 56. The serrations are configured to prevent injury to an individual's hand when grasping the bars 54 and 56. The first and second clamp members 58 and 59 include handles 68 for manually and rotationally urging locking pads 70 into forcible engagement with the predetermined object 13.

The first clamp bar 54 includes a first vertical end portion 78 integrally joined to a top portion 79 of the first arm 22 of the first form 12, a second vertical portion 80 integrally joined to a top portion 82 of the second arm 24 of the first form 12, and a horizontal mid-portion 84 integrally joined to the first and second vertical end portions 78 and 80. The first clamp bar 54 configuration promotes the manual lifting and carrying of the first form 12 such that the first form 12 does not engage the legs of the person carrying the form 12.

The second clamp bar 56 includes a first vertical end portion 86 integrally joined to a top portion 88 of the first arm 28 of the second form 14, a second vertical portion 90 integrally joined to a top portion 92 of the second arm 30 of the second form, and a horizontal mid-portion 94 integrally joined to the first and second vertical end portions 86 and 90. The second clamp bar 56 configuration promotes the manual lifting and carrying of the second form 14 such that the second form 14 does not engage the legs of the person carrying the form 14.

The locking plate 60 cooperates with a bias member (not depicted) such as a spring to promote the locking of the first and second clamp members 58 and 59 upon the first and second clamp bars 56 and 58 via the spring pushing upon a first end 62 of the locking plate 60. The force of the spring is specified to allow the locking plate 60 to be manually released from its maintained position when a person pushes on a second end 64 of the locking plate 60. The spring forces corresponding portions of the locking plate 60 to engage and grasp cooperating portions of respective side walls 76 (which may be serrated to increase friction between the plate 60 and side wall 76) of the clamp bars 54 and 56, thereby maintaining a selected position for a respective clamp member 58 and 59 upon the clamp bars 54 and 56 relative to the predetermined object 13. The spring promotes the forcible engagement of the locking pads 70 against the predetermined object 13 to ultimately maintain the positions of the first and second forms 12 and 14 relative to the predetermined object 13 when concrete is poured into the joined first and second forms 12 and 14, the concrete ultimately hardening and configuring a foundation about the predetermined object 13. After the concrete sufficiently hardens, the securing members 20 are separated from the predetermined object 13, and the first and second securing rods 50 and 52 are manually removed from the angle plates 16, whereupon, the first and second forms 12 and 14 are removed from the hardened concrete.

To promote faster re-use of the device 10 with another column 13, the first and second mid-portion edges 26 and 32 may include first and second hinges (not depicted), the first and second hinges cooperate to provide first and second pivoting arms for each form 12 and 14 to allow the first and second forms 12 and 14 to quickly separate from the hardened concrete.

The preferred embodiment of the present invention provides for the first and second forms 12 and 14 encasing concrete inside the periphery of the forms 12 and 14. Alternatively, the first and second forms 12 and 14 could be used to form concrete outside of the periphery of the forms 12 and 14. The only modification to the forms 12 and 14 would be to relocate the securing of the joining member 16, elevating rods 34, upper slide channel 36, lower threaded channel 38, and first and second vertical end portions 78, 80, 86 and 90 from outside walls 96 to inside walls 98 of the first and second forms 12 and 14.

In operation, first and second forms 12 and 14 are configured and dimensioned to "surround" a structure, such as a vertical column 13, and provide a form that ultimately receives relatively liquid concrete therein. The forms 12 and 14 are joined together, via angled metal plates 16, sufficiently snug so that concrete will not "leak" from the joined forms 12 and 14. The forms 12 and 14 are then horizontally leveled upon a column foundation 21 or undulating ground via elevating rods 34, thereby promoting a horizontally planar concrete surface after the concrete is poured into the forms 12 and 14, manually "smoothed" and allowed to harden. Before the concrete is poured into the joined forms 12 and 14, the forms 12 and 14 are secured to the vertical column 13 via securing members 20 to stabilize and maintain the position of the joined forms 12 and 14, when relatively heavy concrete engages and "pushes upon" the forms 12 and 14. After the concrete hardens, the forms 12 and 14 are quickly separated via the metal plates 16 and removed from the hardened concrete, then manually carried to another vertical column 13 where the method for forming concrete about a column 13 is repeated.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A device for forming concrete comprising:

a first form dimensioned to surround substantially one-half of a predetermined object from a preselected distance;

a second form dimensioned to surround substantially one-half of the predetermined object from substantially the same preselected distance, said first form includes first and second rectangularly configured arms, when taking side views of said arms, and said second form includes first and second rectangularly configured arms, when taking side views of said arms;

means for detachably joining end portions of said first and second forms; and means for removably securing said first and second forms to the predetermined object, said securing means comprising:

a first clamp bar joined to said first and second arms of said first form;

a second clamp bar joined to said first and second arms of said second form;

opposing first clamp members slidably secured to said first clamp bar, each of said opposing first clamp members including at least one locking plate for maintaining a selected position for a respective first clamp member upon said first clamp bar, said locking plate having means for releasing said maintained selected position, said first clamp members including means for manually urging locking pads into forcible engagement with the predetermined object; and opposing second clamp members slidably secured to said second clamp bar, each of said opposing second clamp members including at least one locking plate for maintaining a selected position for a respective second clamp member upon said second clamp bar, said locking plate having means for releasing said maintained selected position, said second clamp members including means for manually urging locking pads into forcible engagement with the predetermined object;

whereby said joined first and second forms remain stationary as concrete is poured into said joined first and second forms to ultimately harden and configure a foundation about the predetermined object.

2. The device of claim 1 wherein said first and second clamp bars are configured and secured to respective first and second forms such that opposite top and bottom planar walls form surfaces that promote the lifting and carrying of said first and second forms by an individual, said first and second clamp bars include opposite side walls with serrations that promote the locking of said locking plate of said first and second clamp members upon respective first and second clamp bars, said serrations being configured to prevent injury to the individual's hands.

3. The device of claim 2 wherein said first clamp bar includes a first vertical end portion integrally joined to a top portion of said first arm of said first form, a second vertical portion integrally joined to a top portion of said second arm of said first form, and a horizontal mid-portion integrally joined to said first and second vertical end portions, said first clamp bar configuration promoting the manual lifting and carrying of said first form.

4. The device of claim 2 wherein said second clamp bar includes a first vertical end portion integrally joined to a top portion of said first arm of said second form, a second vertical portion integrally joined to a top portion of said second arm of said second form, and a horizontal mid-portion integrally joined to said first and second vertical end portions, said second clamp bar configuration promoting the manual lifting and carrying of said second form.

5. The device of claim 1 wherein said locking plate releasing means includes a bias member urging a first end of said locking plate such that said first end and a second end of said locking plate forcibly engage cooperating portions of respective serrated side walls of said clamp bars thereby maintaining the position of said clamp members relative to the predetermined object and promoting the forcible engagement of said locking pads against the predetermined object to ultimately maintain the positions of said first and second forms relative to the predetermined object when concrete is poured into said joined first and second forms to ultimately configure a foundation about the predetermined object.

6. A device for forming concrete comprising:

a first form dimensioned to surround substantially one-half of a predetermined object from a preselected distance;

a second form dimensioned to surround substantially one-half of the predetermined object from substantially the same preselected distance, said first and second forms including means for elevating said first and second forms a preselected elevation above the foundation, said elevating means including an elevating rod disposed at a vertical mid-portion edge of said first form, an elevating rod disposed at a vertical mid-portion edge of said second form, elevating rods disposed adjacent to joining members, an upper slide channel and a lower threaded channel, said upper slide channel being configured and dimensioned to allow an elevating rod to insert therethrough, said lower threaded channel including an inner threaded wall that cooperates with a threaded end of said elevating rod to rotationally receive said threaded end of said elevating rod therethrough, such that a tip portion of said threaded end engages a foundation surrounding the predetermined object and ultimately elevates a corresponding vertical mid-portion edge above the foundation, thereby promoting the elevation of a respective form above the foundation to ultimately achieve a preselected concrete configuration about the predetermined object;

means for detachably joining end portions of said first and second forms; and means for removably securing said first and second forms to the predetermined object, whereby said joined first and second forms remain stationary as concrete is poured into said joined first and second forms to ultimately harden and configure a the foundation about the predetermined object.

7. A device for forming concrete comprising:

a first form dimensioned to surround substantially one-half of a predetermined object from a preselected distance;

a second form dimensioned to surround substantially one-half of the predetermined object from substantially the same preselected distance, said first form includes first and second rectangularly configured arms, when taking side views of said arms, and said second form includes first and second rectangularly configured arms, when taking side views of said arms;

means for detachably joining end portions of said first and second forms, said joining means comprising:

an angled plate integrally joined to an end portion of said first arm of said first form, said angled plate includes an end portion having an aperture therethrough;

an aperture through an end portion of said second arm of said first form;

an angled plate integrally joined to an end portion of said first arm of said second form, said angled plate includes an end portion having an aperture therethrough;

an aperture through an end portion of said second arm of said second form;

a first securing rod ultimately extending through said aperture in said end portion of said angled plate joined to said end portion of said first arm of said first form, and through said aperture in said end portion of said second arm of said second form; and a second securing rod ultimately extending through said aperture in said end portion of said angled plate joined to said end portion of said first arm of said second form, and through said aperture in said end portion of said second arm of said first form; and means for removably securing said first and second forms to the predetermined object, whereby said joined first and second forms remain stationary as concrete is poured into said joined first and second forms to ultimately harden and configure a foundation about the predetermined object, whereupon, a first mid-portion edge of said first form that includes a first hinge, and a second mid-portion edge of said second form that includes a second hinge, cooperate to provide first and second pivoting arms for respective first and second forms to allow said first and second forms to quickly separate from hardened concrete, thereby promoting a faster re-use of said device with another predetermined object.

8. The device of claim 7 wherein said first and second securing rods include nails inserted such that the heads of said nails do not engage concrete.

9. The device of claim 7 wherein said first and second forms are fabricated from metal.

* * * * *